United States Patent [19]
Birk
[11] 4,211,056
[45] Jul. 8, 1980

[54] CASE FILLING APPARATUS

[75] Inventor: Edward W. Birk, Fort Atkinson, Wis.
[73] Assignee: Crepaco, Inc., Lake Mills, Wis.

[21] Appl. No.: 954,872
[22] Filed: Oct. 26, 1978
[51] Int. Cl.[2] ..... B65B 21/06; B65B 21/18
[52] U.S. Cl. ..... 53/543; 53/496; 53/498; 53/247
[58] Field of Search ..... 53/247, 531, 539, 543, 53/496, 537, 448, 498

[56] References Cited

U.S. PATENT DOCUMENTS

| | | | |
|---|---|---|---|
| 2,630,951 | 3/1953 | Slightam | 53/448 |
| 3,311,217 | 3/1967 | Muhlenbruch | 53/543 X |
| 3,410,046 | 11/1968 | Johnson | 53/539 X |
| 3,509,691 | 5/1970 | Wild | 53/247 |

*Primary Examiner*—Travis S. McGehee
*Attorney, Agent, or Firm*—Neuman, Williams, Anderson & Olson

[57] ABSTRACT

An apparatus of high capacity is provided for simultaneously filling a plurality of individual containers into a predetermined number of empty cases. The containers are conveyed to two staging areas disposed in adjacent relation to a first station and then are simultaneously moved from each staging area to the first station. When the containers are disposed at the first station, they are arranged in a predetermined pattern which is compatible with the interior configuration of the cases into which they are to be loaded. A second station is provided which is disposed beneath the first station and is adapted to receive a predetermined number of empty cases to be filled by the container positioned at the first station. A means is provided which releasably engages the containers at the first station, lowers said containers into the empty cases at the second station, and then releases the containers in the cases and returns to its initial position.

9 Claims, 19 Drawing Figures

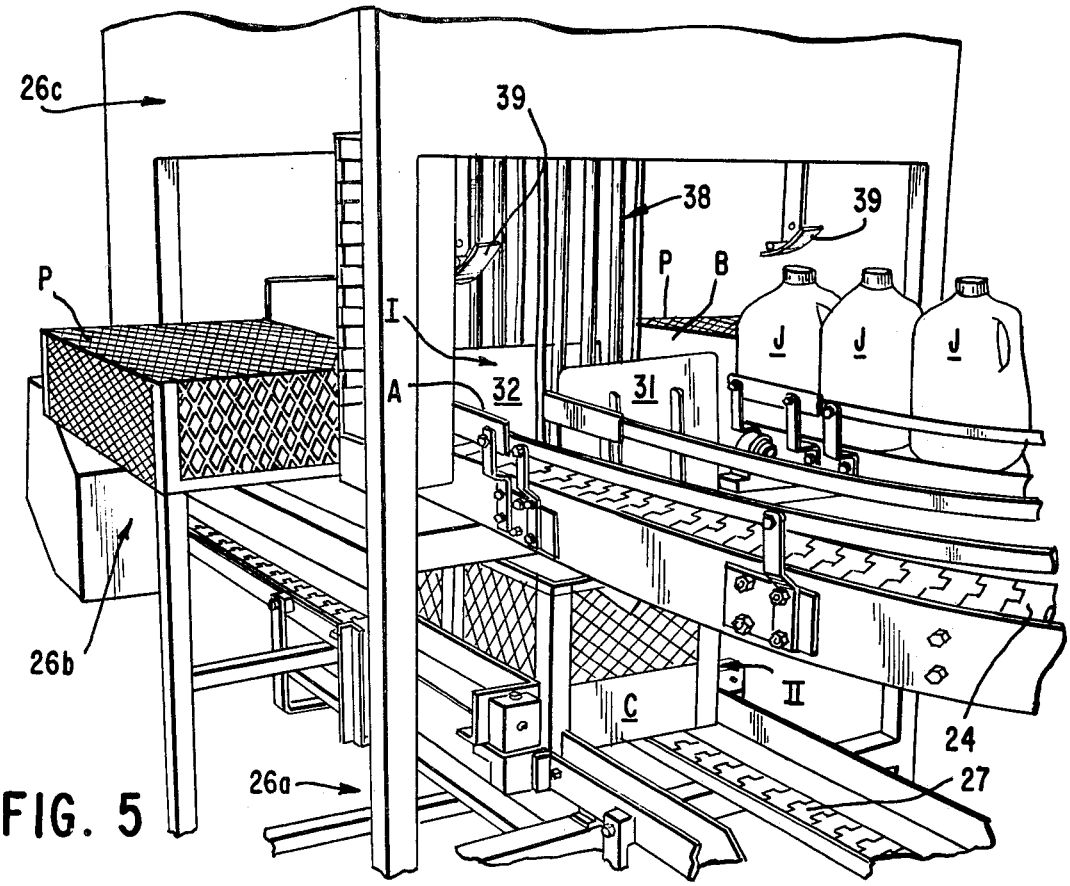
FIG. 5
FIG. 6
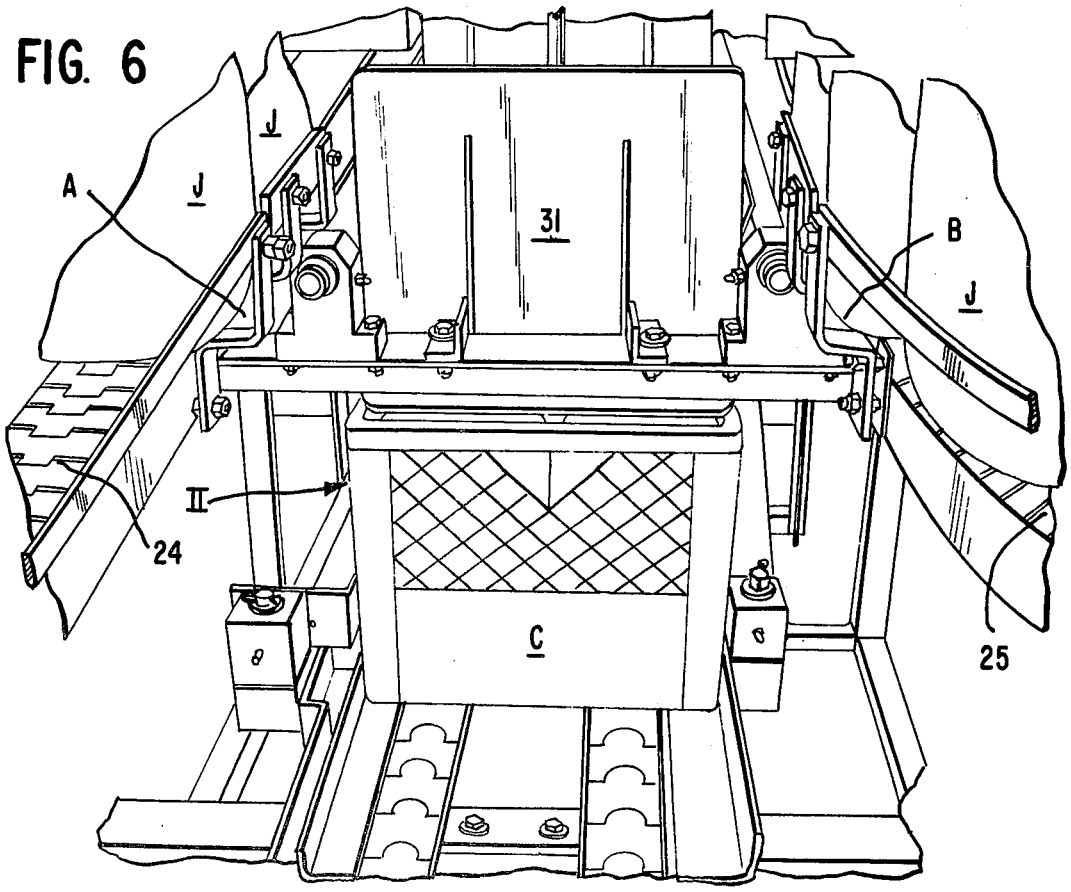

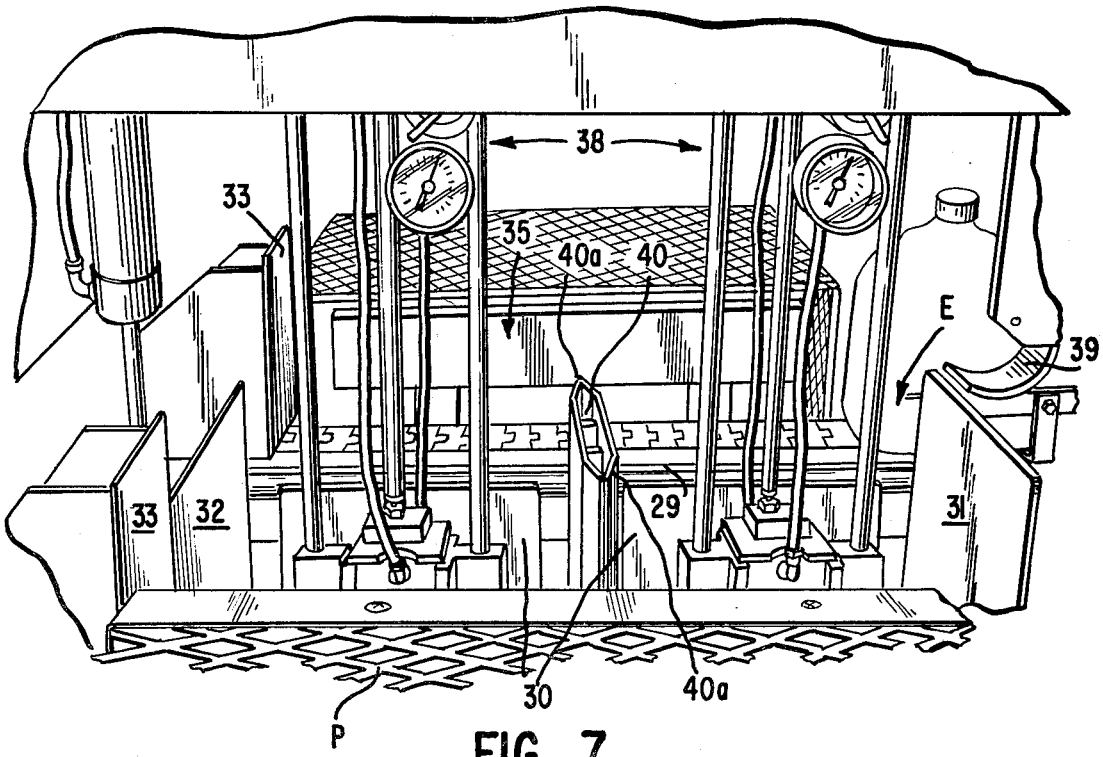
FIG. 7
FIG. 8
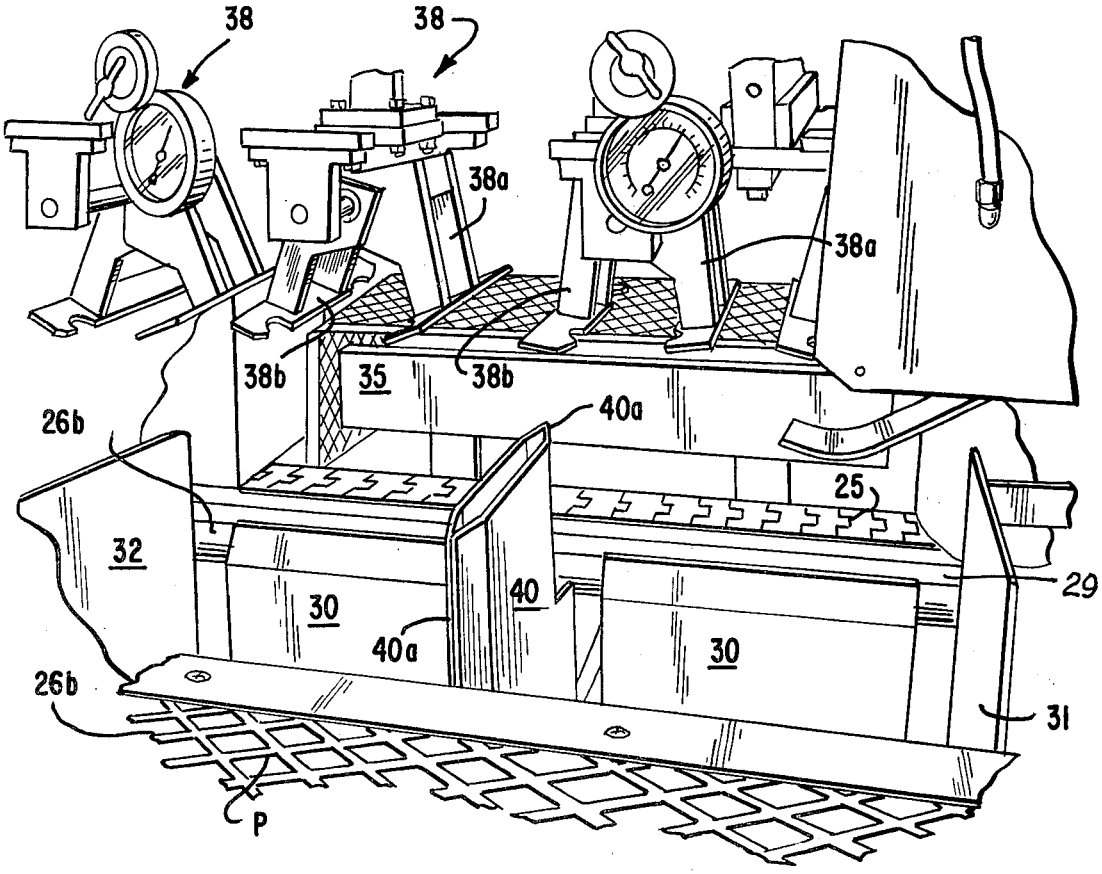

CASE FILLING APPARATUS

BACKGROUND OF THE INVENTION

With the advent and increased popularity of the one gallon size plastic containers, such as jugs for milk or other liquid products, and the introduction of high-speed (e.g., 96–100 jugs per minute) fillers for such containers serious difficulty has been encountered in casing such containers for subsequent distribution to the customers. Various case filling apparatus for such products have heretofore been provided; however, because of inherent design features they have been beset with one or more of the following shortcomings: (a) the optimum capacity of such apparatus is incapable of handling the volume of containers discharged from the filler; thereby requiring several case filling apparatus to handle the output of a single high-speed filler which, in turn, results in substantially increased operational costs and requires substantially greater floor space to accommodate such apparatus; (b) the high-speed case filling apparatus is inordinately expensive to purchase, to operate and to maintain in proper working condition; (c) the apparatus is incapable of handling various size and shape containers and cases; (d) the apparatus is prone to malfunction causing frequency shutdown of the filler line; and (e) in many instances the case filling apparatus handles the containers and/or cases in an abusive manner resulting in the containers and cases being ruptured, defaced or permanently damaged while passing through the apparatus.

SUMMARY OF THE INVENTION

Thus, it is an object of the invention to provide a high-capacity case filling apparatus which avoids all of the aforenoted shortcomings associated with prior apparatus of this general type.

It is a further object of the invention to provide a high-capacity apparatus which is of simple, compact, yet sturdy construction and has a capacity which may be varied to accommodate the output of the container filler.

It is a further object of the invention to provide a high-capacity apparatus wherein various components thereof may be readily replaced with a minimum amount of downtime, and the apparatus is capable of being readily cleaned so as to meet rigid sanitary requirements.

Further and additional objects will appear from the description, accompanying drawings, and appended claims.

In accordance with one embodiment of the invention, a case filling apparatus is provided which includes a first station at which a predetermined number of individual filled containers are accommodated and arranged in a given pattern. Disposed beneath the first station is a second station for receiving a predetermined number of empty cases to be subsequently filled simultaneously with the containers located at said first station. Disposed adjacent to the first station are staging areas wherein a predetermined number of filled containers are assembled prior to being moved to the first station. The first station is provided with an adjustable support member which is mounted for movement between operative and inoperative modes. When in an operative mode, the member subtends and supportingly engages the pattern of filled containers disposed at said first station and blocks passage of said containers from said first station to the empty cases at the second station. When the member is in an inoperative mode, the pattern of containers may pass unobstructed from the first station to the empty cases at said second station and effect filling thereof. Disposed at an initial or rest position adjacent to and above the first station is an assembly which is adapted to engage the containers at the first station and hold same in a suspended position, while the member is moved to the inoperative mode. Once the member assumes the inoperative mode, the assembly will cause the engaged containers to move as a unit downwardly into the empty cases disposed at the second station. Subsequent to depositing the containers into the empty cases, the assembly disengages the deposited containers and then moves upwardly to its initial or rest position to await the next group of loaded containers to be received at the first station.

DESCRIPTION

For a more complete understanding of the invention reference should be made to the drawings wherein:

FIG. 5 is similar to FIG. 2, but showing the assembly lowering a group of containers into the empty cases at the second station.

FIG. 6 is a close-up fragmentary perspective view showing an empty case disposed at the second station and in position to be filled and a group of containers being assembled at the staging areas.

FIG. 7 is similar to FIG. 4 but showing the assembly in a case filling position.

FIG. 8 is similar to FIG. 7 but showing the assembly returned to its initial position and components thereof in container-receiving condition; the adjustable member, however, is shown in an inoperative mode.

Figure 1:
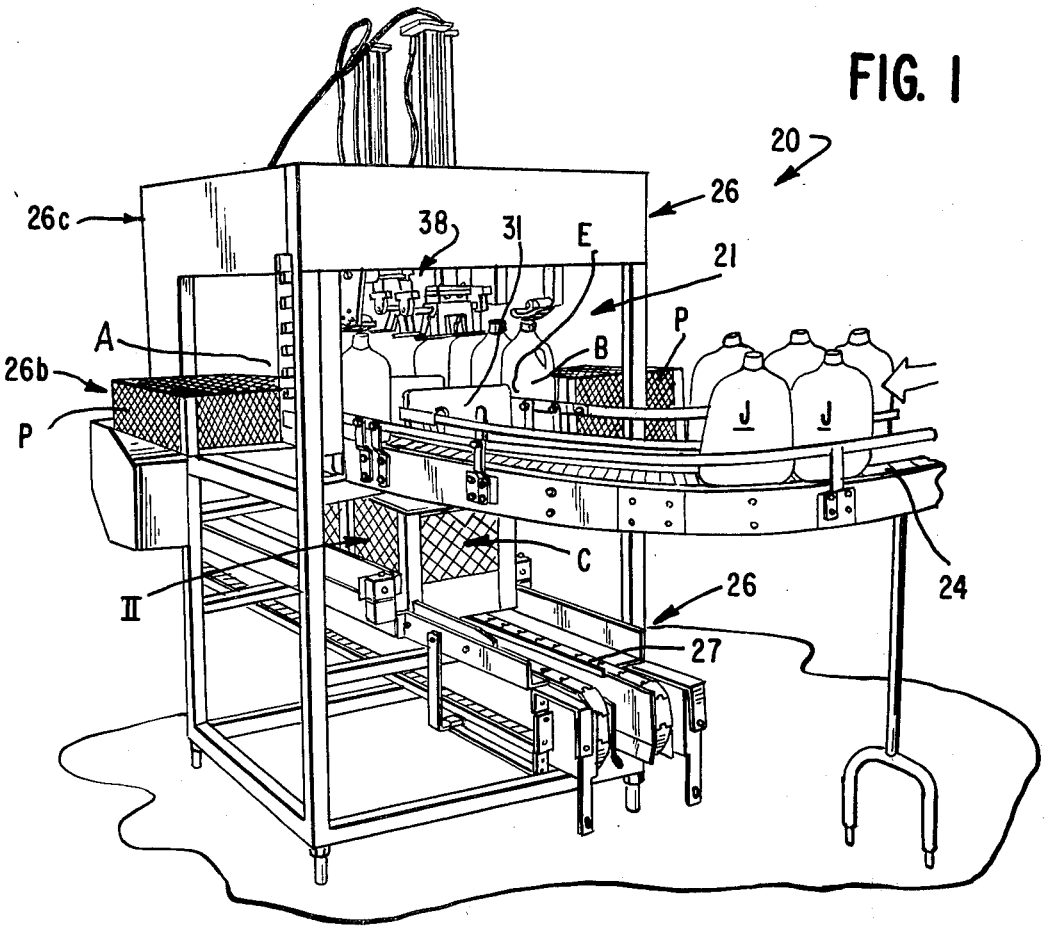
FIG. 1 is a fragmentary perspective view of one end portion of one form of the improved case filling apparatus and showing a predetermined number of filled containers assembled at both staging areas prior to being moved to the first station.
Figure 9:
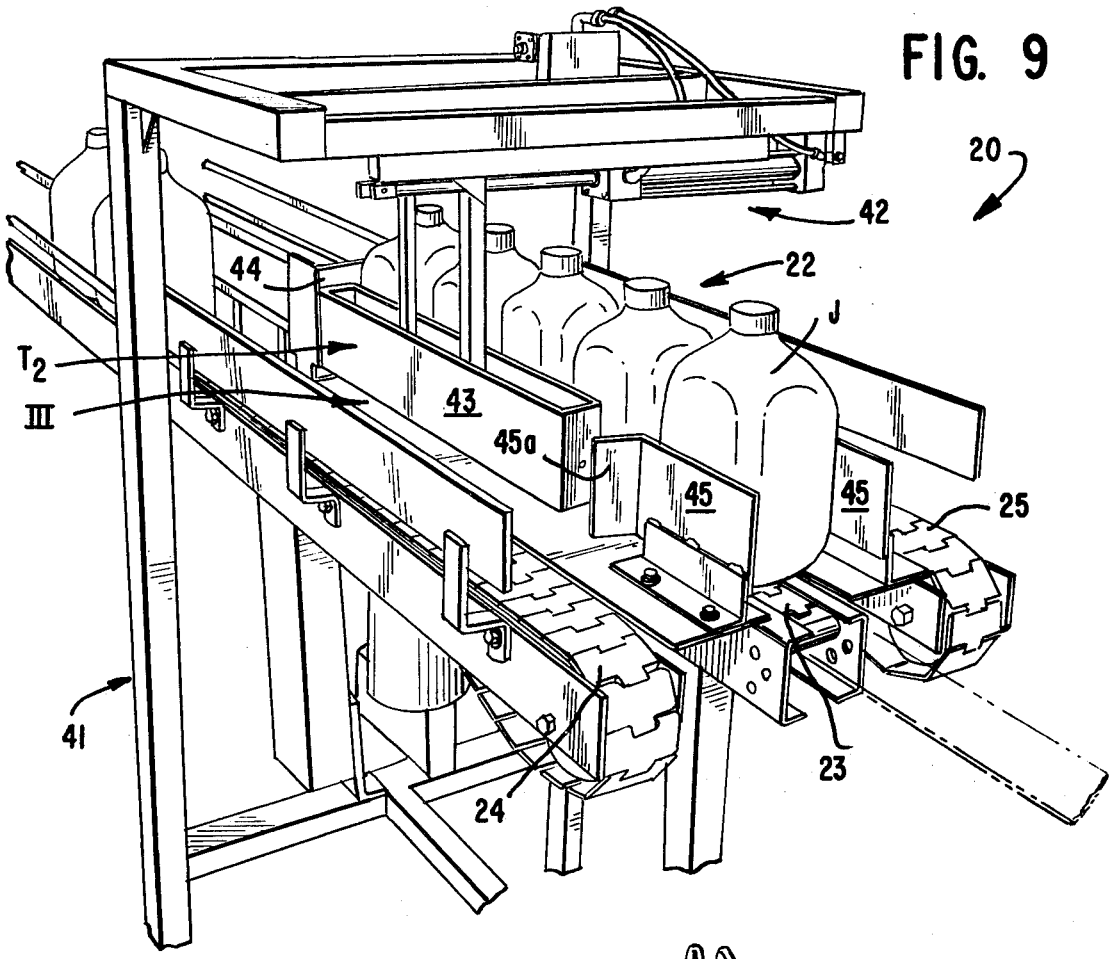

FIG. 9 is a fragmentary perspective view of a second end portion of the case filling apparatus which is spaced from the end portion shown in FIG. 1; the second end portion being viewed from the infeed side thereof (e.g., side closest to the container filler) and showing an elongated pusher of a splitter unit in one terminal position and poised to move a predetermined number of containers from a single infeed conveyor onto one of the dual conveyors.

Figure 10:
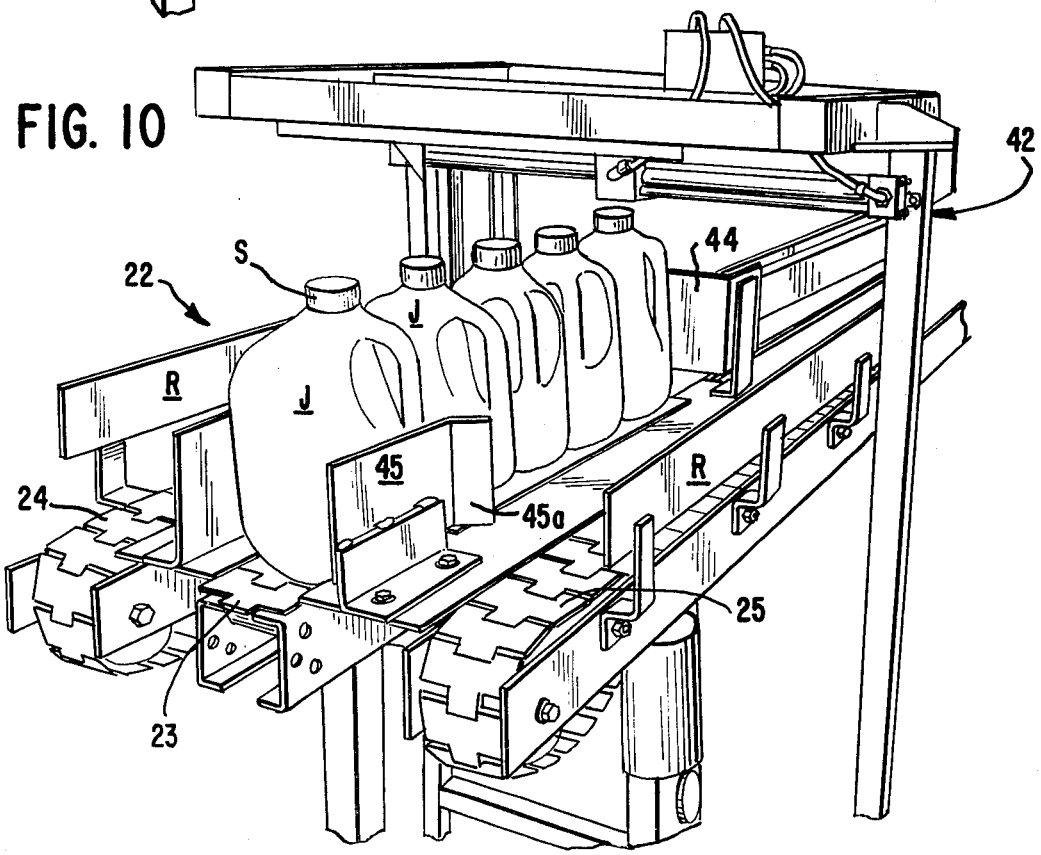

FIG. 10 is similar to FIG. 9 but showing the pusher obscured by the containers disposed on the single infeed conveyor.

Figure 11:
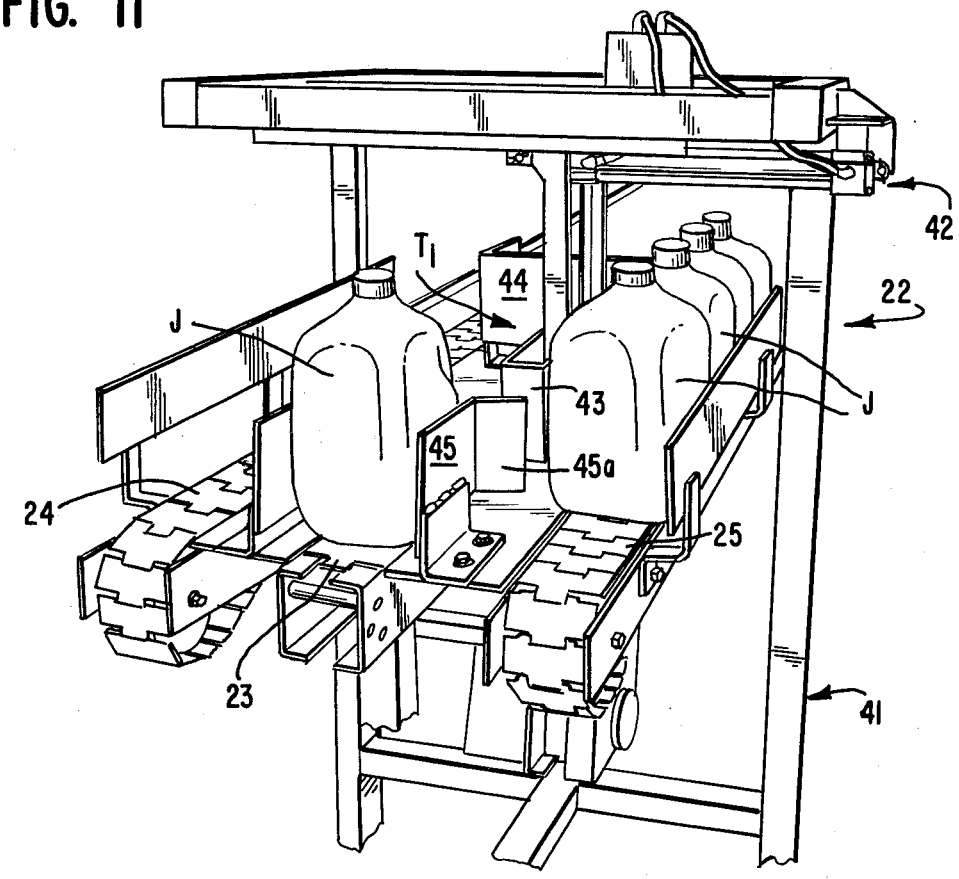

FIG. 11 is similar to FIG. 10 but showing a predetermined number of filled containers subsequent to being moved onto one of the dual conveyors by the pusher.

Figure 12:
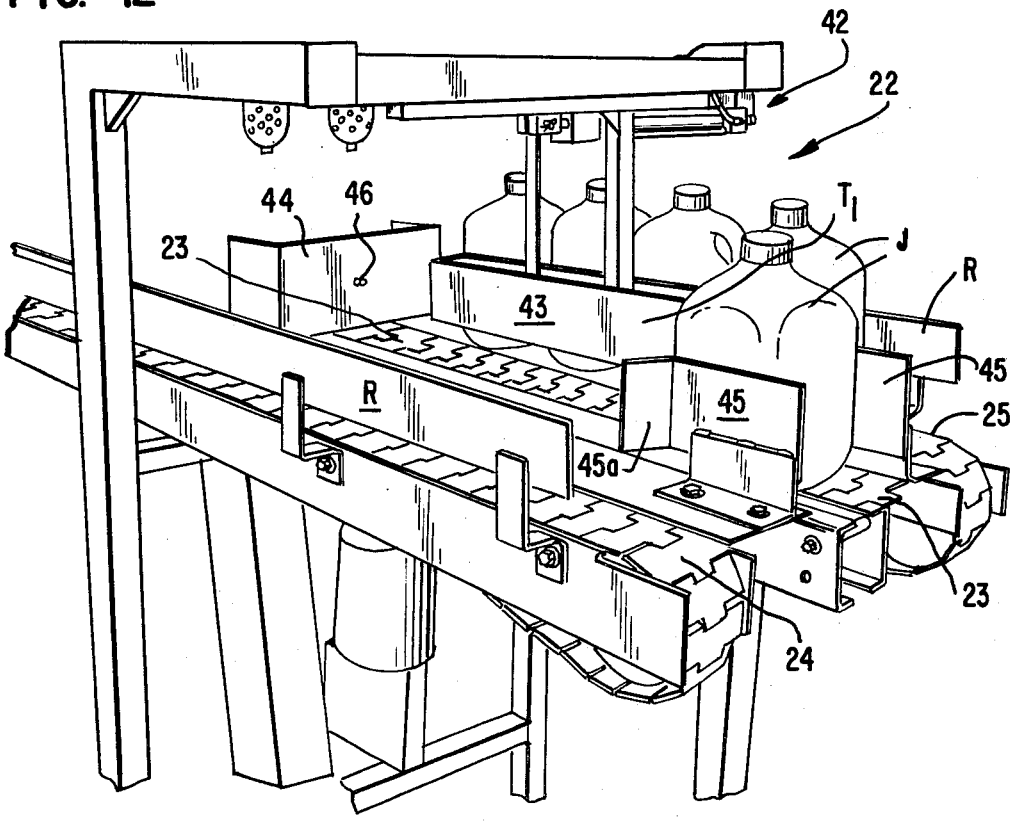

FIG. 12 is similar to FIG. 11 but showing more clearly the pusher in the second terminal position.

Figure 13:
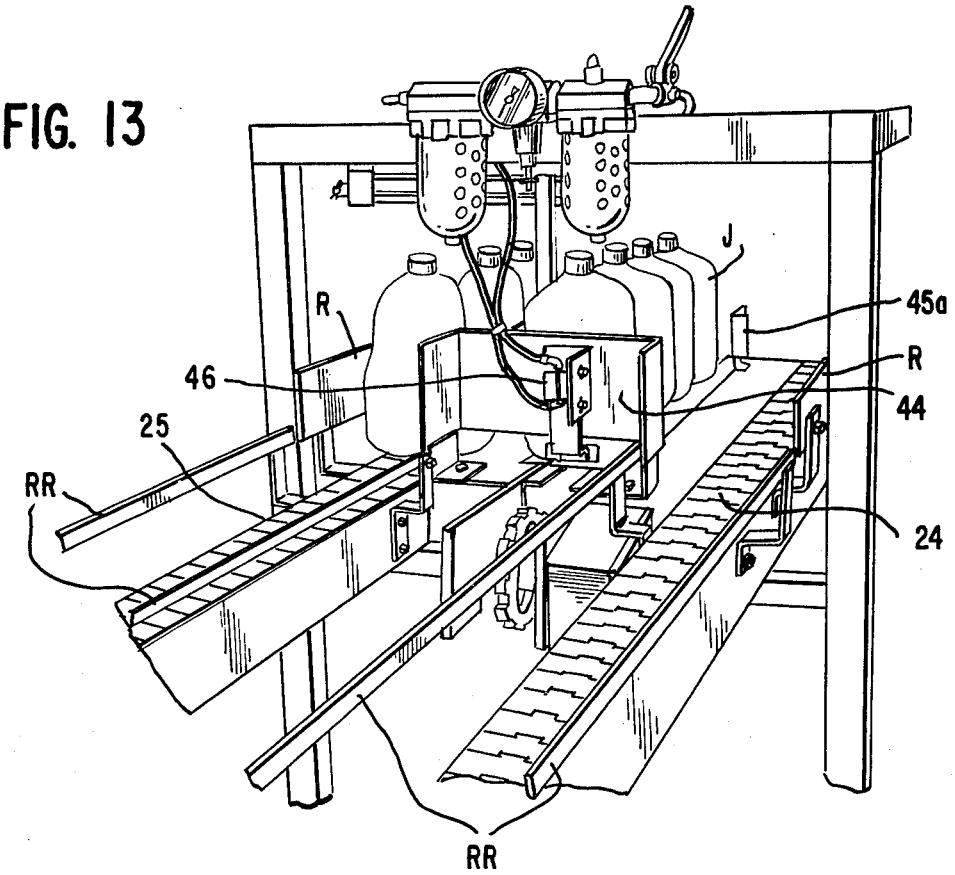

FIG. 13 is similar to FIG. 9 but showing the discharge side of the second end portion.

Figure 14:
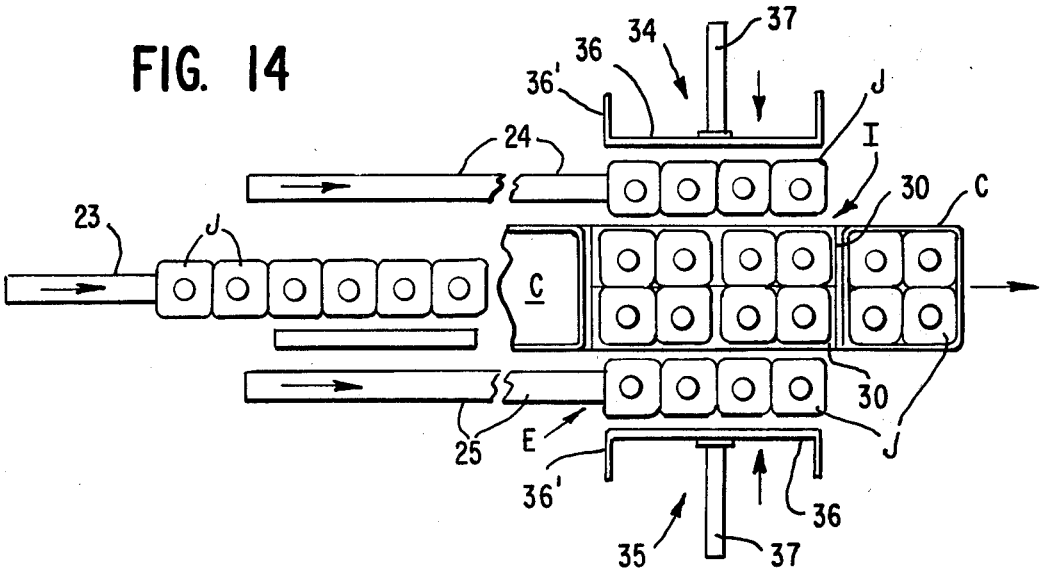
Figure 15A:
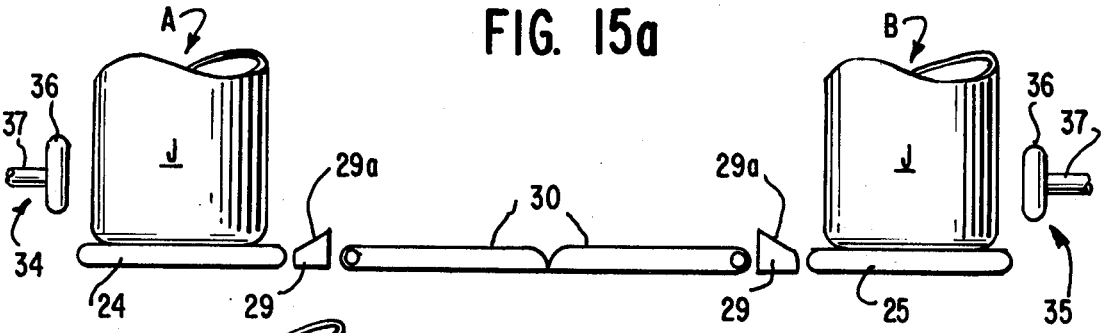
Figure 15B:
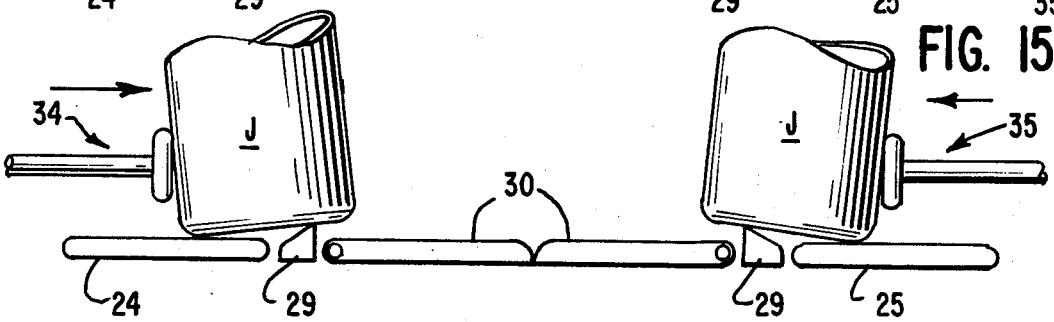
Figure 15C:
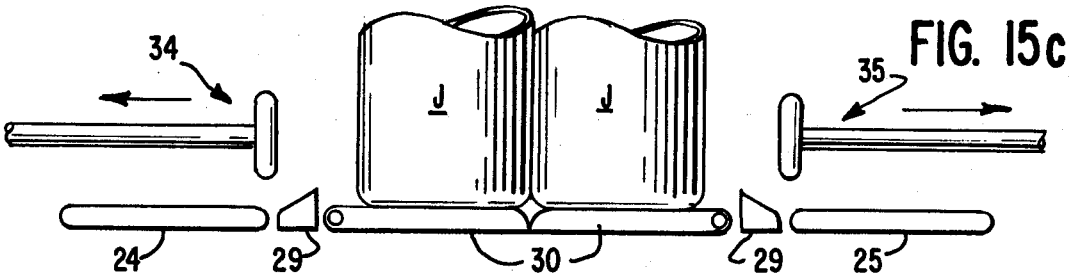
Figure 15D:
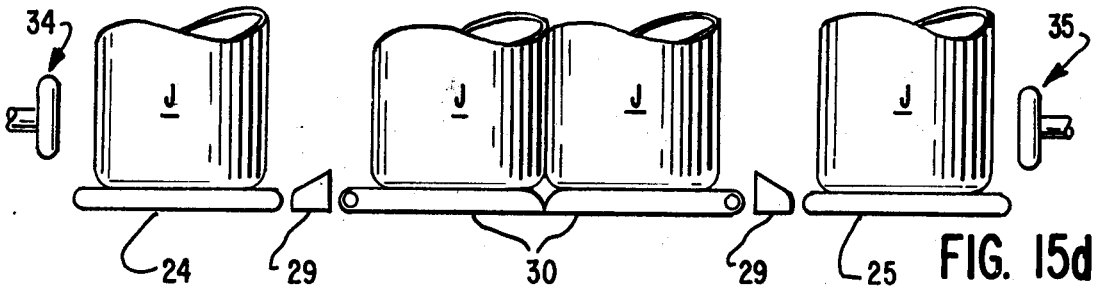
Figure 15E:
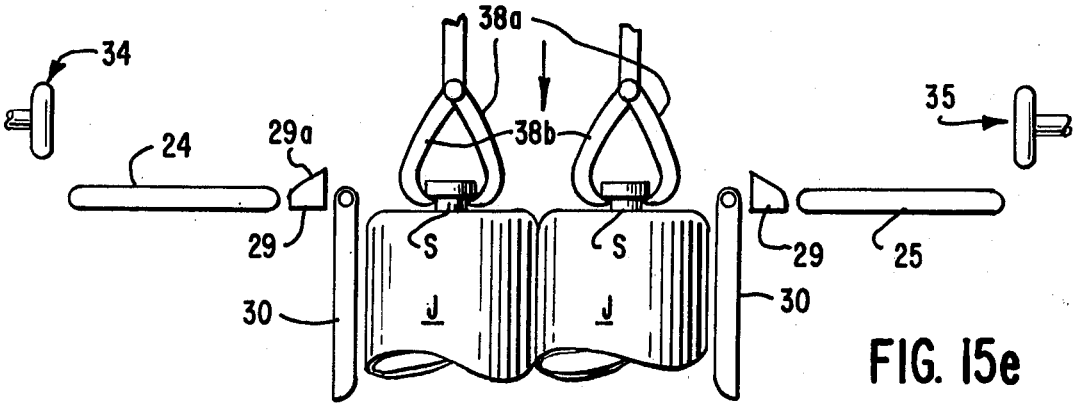

FIG. 14 is a fragmentary diagrammatic plan view showing the relative positions of various containers disposed at both end portions of the improved case filling apparatus.

FIGS. 15*a*–15*e* are schematic diagrams of the first station and adjacent staging areas showing the sequence of operations in moving the loaded containers from the staging areas to the first station and then moving of the containers downwardly from the first station towards the second station.

Referring now to the drawings, an improved high-capacity case filling apparatus 20 is shown which is adapted to be used in a diary plant or the like in conjunction with a high-speed filler, not shown, capable of filling gallon size plastic containers such as jugs J at a rate of approximately 96–120 jugs per minute. The apparatus will be described hereinafter with relation to jugs; however, it is not intended to be limited for use with such type containers.

The jugs are of conventional design and are blow molded from polypropylene or similar plastic material and each is provided at the top thereof with a centrally disposed upwardly projecting spout S having a removable closure cap mounted thereon. The thickness of the plastic material and the inherent characteristics of the plastic itself are such that the jug J, even when filled with a liquid product, will distort a slight amount when an external pushing force is exerted on the side of the jug. It is for this reason, therefore, that many prior high-speed case filling apparatus could not effectively handle such jugs without causing serious jamming problems, particularly when the speed of operation is in the range of 96–120 jugs per minute.

The apparatus 20, in the illustrated embodiment, includes a downstream end portion or section 21 (see FIGS. 1–8) wherein the jugs J are assembled and arranged in a predetermined pattern and then simultaneously deposited into one or more empty cases C. An upstream end portion or section 22 (see FIGS. 9–13) also forms a part of the apparatus 20 and is adapted to intermittently segregate or split a predetermined number of filled jugs J being fed in tandem on single conveyor 23 from a high-speed jug filler (not shown) onto one of the dual conveyors 24, 25; the latter being disposed horizontally on opposite sides of the single conveyor and extending to the downstream section 21. The jugs, when disposed on the dual conveyors, are in staggered groups with the jugs of each group having the capped spouts thereof facing upwardly. The length and path of travel of the jugs along the dual conveyors 24, 25 will depend upon the physical layout of the plant in which the case filling apparatus is located. In some instances, however, section 22 of the apparatus 20 may be omitted where there is a dual conveyor system leaving the jug filler.

The downstream section 21 comprises a frame 26 having lower, middle, and upper segments 26*a*, 26*b*, 26*c*, respectively. The middle segment 26*b* is disposed at an elevation corresponding substantially to the elevation of the dual conveyors 24, 25 at the section 21 and is provided with a first station I. The lower segment 26*a* of the frame is vertically spaced beneath middle segment 26*b* by an amount such that cases C may pass therebeneath. The lower segment supports a conveyor 27 for the cases C. A predetermined number of jugs J are simultaneously loaded into one or more empty cases when the latter are located at a second station II, as will be described more fully hereinafter.

The upper frame segment 26*c* is elevated a substantial distance above the middle segment 26*b* and supports an assembly 28 which will effect intermittent transfer of a predetermined number of jugs from the first station to the second station in a manner to be described in detail hereinafter.

The first station I includes one or a plurality of plate-like members 30 (see FIGS. 8 and 14) hingedly mounted on horizontally spaced portions of the middle segment 26*b* for movement between operative and inoperative modes. When the members 30 are in an operative mode, they are disposed in a horizontal substantially coplanar relation and define a supporting base surface onto which a predetermined number of containers are intermittently moved and assume a predetermined pattern prior to being lowered into one or more empty cases C disposed at station II. Positioned at opposite ends of members 30 and extending transversely of the hinge axes thereof is a pair of upright guide plates 31, 32. The spacing between plates 31, 32 is dependent upon the desired pattern or arrangement of the jugs when they are assembled at the station I and supported by the members 30 while the latter are in an operative mode.

Prior to being assembled at station I, a predetermined number (e.g., four) of jugs J are fed by the dual conveyors 24, 25 to horizontal staging areas A and B which are disposed laterally on opposite sides of the first station I. The portions of the conveyors 24, 25 located in the staging areas are substantially coplanar with the plane defined by members 30 when in an operative mode. When the jugs are conveyed onto the staging areas A, B, the leading jug at each area will be moved along by one dual conveyor 24, 25 until it engages a stop 33 which is disposed a predetermined distance downstream from the entry E to the staging area. As seen in FIGS. 15*a*–15*e* there are disposed between the plate members 30 and the corresponding dual conveyors 24, 25, elongated curb pieces 29. Each piece 29 has a top surface 29*a* which slopes upwardly slightly above the plane of the adjacent conveyor 24, 25 and prevents the jugs when being moved into position on the staging area A, B from wandering off the conveyor.

Figure 2:
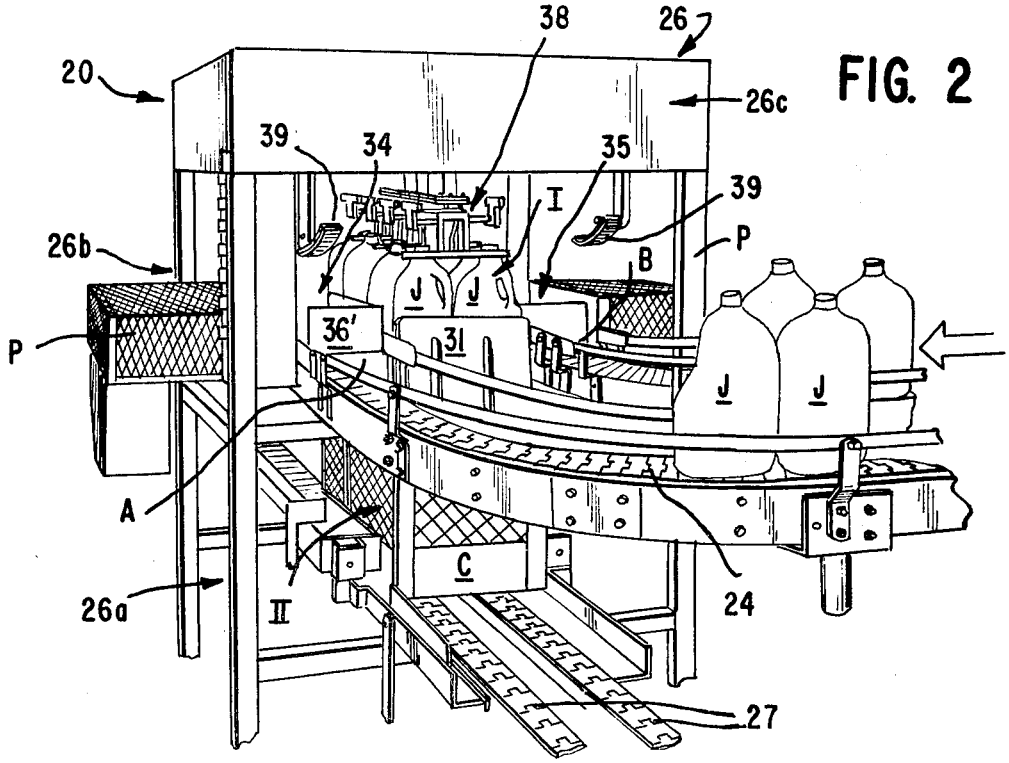
FIG. 2 is similar to FIG. 1 but showing the filled containers in a desired pattern and disposed at the first station and in registration with and supported by the adjustable member; the latter being in an operative mode.
Figure 3:
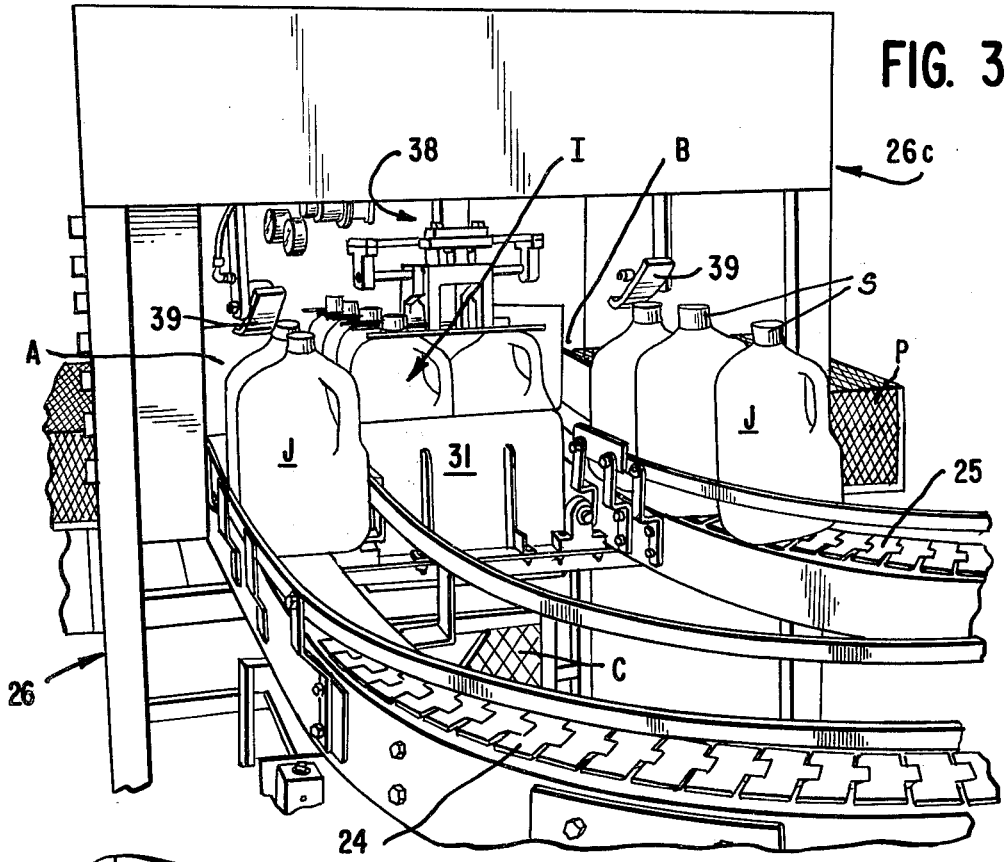
FIG. 3 is a close-up fragmentary perspective view of the apparatus end portion of FIG. 1 and showing one group of filled containers at the first station and second groups of containers being assembled at the staging areas.
Figure 4:
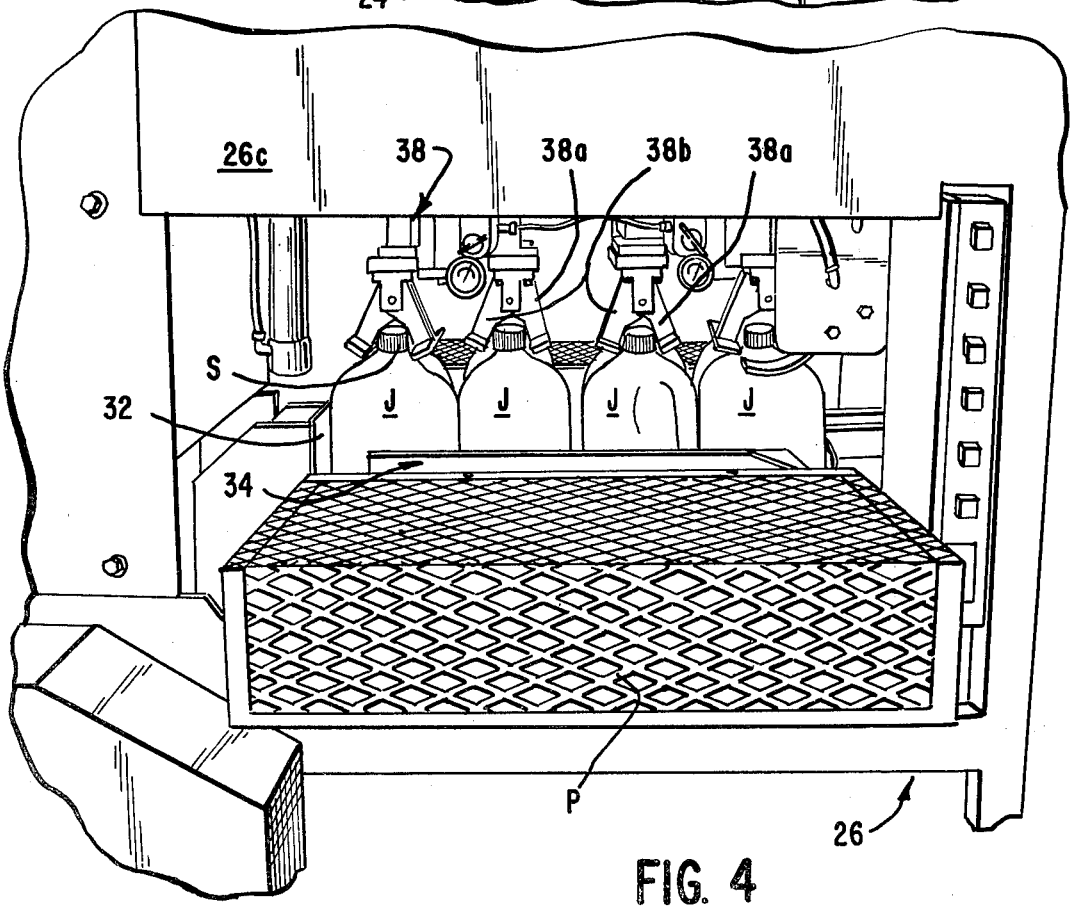
FIG. 4 is an enlarged fragmentary perspective side view of the apparatus end portion of FIG. 1 and showing the containers at the first station about to be engaged by components of the assembly.

When the required number of jugs aligned in side-by-side tandem relation have been assembled at each staging area, the latter having a length defined by stop 33 and the corresponding entry E, the containers in the staging areas are simultaneously moved laterally off the conveyors 24, 25 over the respective curb pieces 29 towards one another onto the plate members 30 which had previously assumed an operative mode. The lateral movement of the containers from a staging area A or B onto the members 30 is accomplished by an adjacent pusher unit 34, 35. Each unit is preferably of like construction and includes an elongated bar 36 having a length approximating the distance between the stop 33 and entry E. The ends 36' of each bar are preferably offset at right angles and block movement of the jugs onto the staging area when the bar 36 is at, or moving to or from, an extended position as seen in FIG. 2. The bar, when in a retracted or inoperative position, is disposed outwardly of the adjacent conveyor 24, 25 and is in spaced parallel relation with respect to the direction of travel the jugs when being moved onto the staging area by one of the dual conveyors 24, 25.

Extending transversely from the outwardly disposed side of bar 36 is one or more guide rods 37 (see FIG. 14). Each rod 37 is preferably pneumatically actuated by suitable means; the source of pneumatic pressure is normally available in the plant in which the apparatus 20 is located. The movement of the bar and rod is controlled by suitable conventional timing means which is substantially enclosed within a protective cagelike member P. The timing means normally includes a trip element 39 disposed at the entry E to each staging area. The element 39 is adjustably mounted on a depending arm and is pivoted by each jug as it moves onto the staging area. When the desired number of jugs have been moved to the staging area, the element 39 will relay this fact to the bar actuating means within the cagelike member P, thereby enabling the bar to be moved from its rest position when certain other operational conditions are met.

When the jugs in the staging areas are moved onto the plate members 30 at station I, the capped spouts S of the jugs J will be disposed between suitable open jaws **38*a*, 38*b* which form a part of the assembly 28. The assembly is disposed in its elevated initial, or rest, position when the jaws receive the spouts S. The jaws are then actuated to a closed condition thereby gripping the spouts aligned therebetween. The closed jaws engage the spouts beneath the closure caps thereof and thus retain the jugs in a suspended state as the plate members 30 assume an inoperative mode. After the members are in an inoperative mode, the assembly 28 causes the jaws 38*a*, 38*b* and suspended jugs to move downwardly as a unit between the open plate members to station II wherein the suspended jugs are accommodated in one or more empty cases C located at station II. In the illustrated embodiment the number of jugs J and the arrangement or pattern thereof at the first station I are such that two empty cases may be simultaneously loaded for each downward stroke of the jaws 38*a*, 38*b***.

To permit simultaneous loading of the two cases, an upright spacer element 40 is provided at station I and is disposed between the two sets of jaws. The thickness of element 40 corresponds to the sum of the thicknesses of the two abutting walls of the adjacent empty cases when the latter are located at station II. The vertical edge portions **40*a* of element 40, which are adjacent the staging areas A, B, are beveled or tapered so as to readily fit between and spread apart two adjacent jugs when the latter are being transferred from the adjacent staging area. The element 40 coacts with the guide plates 31, 32** so as to segregate the jugs as they move to station I into appropriate patterns which are compatible with the interior configurations of the empty cases at station II. Thus, the problem of jamming the apparatus during loading the cases has been readily avoided.

Because of the curblike elements 29 retaining the jugs in tandem alignment, the staging areas A and B may continue to have assembled thereon the required number of jugs even though the jaws **38*a*, 38*b* of the assembly are lowered to effect loading of the cases (see FIG. 7**). By reason of this arrangement, the capacity of the apparatus is significantly increased.

The lengths of the staging areas A, B may be increased so that a larger number of jugs are assembled thereon. For example, instead of four jugs being assembled at each area A, B, six or eight may be assembled thereon and accordingly the interior configurations of the empty cases at station II would be rectangular rather than substantially square. It will be understood, of course, that where the number of jugs assembled at the staging areas is increased, the pairs of jaws comprising the assembly will be increased accordingly.

The section 22, which is shown more clearly in FIGS. 9–13, includes an upright frame 41 which provides support for the single infeed conveyor 23 and the dual conveyors 24 and 25. As aforementioned, the conveyor 23 may extend from a jug filler, not shown, or some other area within the plant. The conveyor 23 is disposed between the dual conveyors 24, 25 and cooperates therewith to form a transfer or third station III. At the third station the jug-supporting surfaces of the conveyors 23, 24, 25 are substantially coplanar.

Supported by frame 41 and located above section III is a splitter assembly 42 which is preferably pneumatically actuated. The assembly 42 includes a depending, elongated blade 43 which is adapted to oscillate in a controlled manner across the portion of conveyor 23 disposed at station III. Adjacent one end of blade 43 is a stop 44 which prevents further travel of the jugs on conveyor 23 beyond station III. Adjacent the opposite end of blade 43 are a pair of upright guide plates 45. The guides are spaced apart so as to allow the jugs to move therebetween by conveyor 23. The edge portions **45*a* of the guide plates 45 disposed in close proximity to the blade end are flared outwardly slightly so that the blade, when moving transversely in either direction across the conveyor 23, will enable a predetermined number or group of the filled jugs to be readily moved simutaneously from the conveyor 23 onto either conveyor 24 or 25. In the illustrated embodiment, the blade 43** moves four jugs on each sweep; however, the number of jugs may be varied as desired.

When the blade 43 has completed one sweep, it will remain in a first terminal position $T_1$ between the side of conveyor 23 and conveyor 25 (see FIGS. 11 and 12) until the required number of additional jugs have assembled on conveyor 23 between the stop 44 and the flared ends of the guide plates 45. Once the required number of additional jugs have been assembled, the blade 43 moves in the opposite direction from terminal position $T_1$ across conveyor 23 to a second terminal position $T_2$ (see FIG. 9). As the blade moves from position $T_1$ to position $T_2$ it will simultaneously move a second group of jugs from conveyor 23 to conveyor 24. The timing of the blade movement is coordinated with the output of the jug filler.

When the blade is disposed in either terminal position, it is out of the travel path of the jugs on either conveyor 23 or conveyors 24, 25.

Disposed outwardly of conveyors 24, 25 are retaining rails R which prevent the jugs from moving laterally too far when being pushed by the blade onto the conveyor 24, 25.

As seen in FIG. 13, stop 44 is provided with a safety switch 46 which must be closed before the blade 43 can be actuated. Closing of switch 46 is effected when the stop 44 is engaged by a jug carried by conveyor 23. A second safety switch, not shown, working in series with switch 46 will be closed when the required number of jugs have been assembled by conveyor 23 at station III. Once both switches have been closed, then the blade 43 will be actuated so as to sweep across the conveyor 23 and transfer the engaged jugs onto either conveyor 24 or 25. If by chance either conveyor 24 or 25 is not operating, then blade 43 will not be actuated even though both of the aforementioned safety switches have previously been closed. The use of such switches and other safety devices are well known in conveyor systems.

The distance and path of travel of the groups of jugs when moving from section 22 to section 21 will depend upon the physical layout of the plant in which the case filling apparatus is installed. As seen in FIG. 13, the segments of the conveyors 24, 25 between sections 22 and 21 are provided with conventional safety rails RR between which the jugs move.

As aforementioned, various components of the improved apparatus herein described may be modified as required to meet a particular operational situation. For example, the exterior configuration of the filled containers may be substantially different from the plastic jugs herein described and, thus, the configuration and movement of the jaws might require change in order to accommodate such containers and the contacting faces of the pusher units may be varied. The interior configuration of the cases will dictate the pattern the containers will assume at station I. The cases into which the containers are loaded may be conventional corrugated fiberboard shipping boxes rather than the plastic and/or wooden cases herein described and illustrated. In any such situations the improved case filling apparatus is readily capable of compensating for such changes without adversely affecting its high-speed operation. Furthermore, the relative location of various components comprising the improved case filling apparatus may be altered so as to meet particular physical space requirements involved in the plant in which the apparatus is installed.

I claim:

1. A high-speed apparatus for use in filling cases with a plurality of containers arranged in side-by-side relation and forming a predetermined pattern, said apparatus comprising a supporting frame having a first station disposed at one level, relatively spaced staging areas disposed at substantially said one level and adjacent said one station and at which predetermined numbers of containers are simultaneously assembled, and a second station disposed at a second level beneath said first level; first means for conveying the containers to said staging areas; second means for conveying a predetermined number of empty cases to said second station; third means for simultaneously transferring the assembled predetermined number of containers from the staging areas to the first station and simultaneously therewith arranging thereon the transferred containers in side-by-side relation forming the predetermined pattern; and fourth means for lowering as a unit the containers while in the predetermined pattern from the first station into the predetermined number of cases at the second station; all of said means being actuated in a predetermined timed sequence.

2. The apparatus of claim 1 wherein the first station includes a supporting means mounted on said frame and adjustable between operative and inoperative modes; said means, when in an operative mode, being adapted to subtend and support the predetermined number of containers transferred by the third means from the staging areas to said first station and obstructing movement of the transferred containers from the first station to the predetermined number of cases at said second station; said means, when in an inoperative mode, assuming a non-obstructive position with respect to the transferred containers whereby the latter while in the predetermined pattern are lowered as a unit by the fourth means into the predetermined number of cases at said second station.

3. The apparatus of claim 2 wherein the staging areas are disposed in substantially opposed relation and on opposite sides of said first station.

4. The apparatus of claim 3 wherein the third means is adapted to simultaneously transfer the predetermined number of containers from the opposed staging areas towards one another onto the first station supporting means when the latter is in the operative mode, the containers when transferred onto the supporting means being simultaneously arranged in side-by-side relation forming the predetermined pattern.

5. The apparatus of claim 3 wherein each staging area includes an elongated curblike element for aligning the assembled containers in a substantially tandem relation.

6. The apparatus of claim 5 wherein each curblike element has a sloping surface over which the containers are caused to slide when being transferred by the third means from the staging areas to the first station.

7. The apparatus of claim 2 wherein the fourth means is proximate to and above said first station and is provided with adjustable container-retaining elements, said elements being initially disposed in first positions of adjustment for engaging each of the containers when transferred from the staging areas and being actuated to second positions of adjustment for retaining the engaged containers in the predetermined pattern at said first station prior to the supporting means assuming an inoperative mode and for subsequently lowering the engaged containers while in said pattern past the inoperative supporting means into the predetermined number of cases at the second station.

8. The apparatus of claim 7 wherein additional containers are adapted to assemble on the staging areas while the retaining elements are lowering the predetermined number of containers from the first station into the predetermined number of cases at the second station.

9. The apparatus of claim 4 wherein the first station includes an upright spacer element disposed within the path of travel of the containers when being transferred from the staging areas to the first station and being adapted to effect separation of the transferred containers into contiguous groups of containers, each group having the containers thereof arranged in the predetermined pattern, the latter being compatible with the interior configuration of a case disposed therebeneath at the second station.

* * * * *